US009795529B2

(12) United States Patent
Lehtio

(10) Patent No.: US 9,795,529 B2
(45) Date of Patent: Oct. 24, 2017

(54) TRANSFER COVER

(71) Applicant: MEDIMATTRESS OY, Helsinki (FI)

(72) Inventor: Juha Lehtio, Espoo (FI)

(73) Assignee: MEDIMATTRESS OY, Helsinki (FI)

( * ) Notice: Subject to any disclaimer, the term of this patent is extended or adjusted under 35 U.S.C. 154(b) by 0 days.

(21) Appl. No.: 14/362,459

(22) PCT Filed: Dec. 7, 2012

(86) PCT No.: PCT/FI2012/051219
§ 371 (c)(1),
(2) Date: Jun. 3, 2014

(87) PCT Pub. No.: WO2013/083881
PCT Pub. Date: Jun. 13, 2013

(65) Prior Publication Data

US 2014/0325754 A1 Nov. 6, 2014

(30) Foreign Application Priority Data

Dec. 8, 2011 (FI) ..... 20116244 U

(51) Int. Cl.
*A61G 7/10* (2006.01)

(52) U.S. Cl.
CPC ..... *A61G 7/1051* (2013.01); *A61G 7/1026* (2013.01)

(58) Field of Classification Search
CPC . A47C 27/0002; A47C 27/005; A47C 27/007; A47C 27/008; A61G 1/01; A61G 7/1025; A61G 7/1026; A61G 7/1051
See application file for complete search history.

(56) References Cited

U.S. PATENT DOCUMENTS 3,829,914 A * 8/1974 Treat ..... A47C 21/00 5/495
4,961,982 A * 10/1990 Taylor ..... A61F 5/485 112/475.08
5,615,425 A 4/1997 Corente
5,787,523 A * 8/1998 Lindberg ..... A47G 9/0238 5/484
6,012,183 A * 1/2000 Brooke ..... A61G 7/1026 5/81.1 C (Continued)

FOREIGN PATENT DOCUMENTS

EP 0800806 10/1997
FI 8909 10/2010

(Continued)

OTHER PUBLICATIONS

International Search Report dated Mar. 26, 2013, corresponding to PCT/FI2012/051219.

(Continued)

*Primary Examiner* — Nicholas Polito
(74) *Attorney, Agent, or Firm* — Young & Thompson

(57) ABSTRACT

An appliance for working with patients, includes an essentially sheet-like basic structure and includes as a combination a layer (1) lying against the base, which slides well in one direction and poorly in another, a support layer (2) permitting lifting, and a moisture-absorbent layer (4), which is equipped with a protective layer (3) impermeable to moisture. It also includes handle parts (7) permitting gripping, on at least two sides.

8 Claims, 1 Drawing Sheet

(56) References Cited

U.S. PATENT DOCUMENTS

| | | | | |
|---|---|---|---|---|
| 6,341,393 | B1 * | 1/2002 | Votel | A61G 7/1019 5/484 |
| 6,658,676 | B1 * | 12/2003 | Persson | A61G 7/1026 5/81.1 HS |
| 2007/0056096 | A1 | 3/2007 | Assink | |

FOREIGN PATENT DOCUMENTS

| | | |
|---|---|---|
| SE | 513412 | 9/2000 |
| WO | 00-23026 | 9/1994 |
| WO | 94-20002 | 6/2004 |
| WO | 2004-050002 | 6/2004 |
| WO | 2010020818 | 2/2010 |

OTHER PUBLICATIONS

Finnish Search Report dated Sep. 27, 2012, corresponding to the Foreign Priority Application No. 20116244.
Supplementary European search report, dated Jul. 13, 2015; Application No. 12 85 5540.

* cited by examiner

TRANSFER COVER

BACKGROUND OF THE INVENTION

Field of the Invention

The present invention relates to a transfer cover and more specifically a device, by means of which it is possible to facilitate and considerably rationalize the moving of a person, particularly a person with limited movement or someone unable to move themselves.

Description of the Related Art

In hospitals, care homes, and similar places, there are many patients or people who are otherwise in poor condition or are restricted in their movements, the care of which always requires at least one or more persons to perform turning over, transfer, and similar operations. The work is ergonomically extremely demanding and hard. Accidents often happen in this work and in turn often lead to sickness leave and put a strain on the use of the services of health-care personnel.

It is obvious that attempts have been made to find solutions to the aforementioned problem in many different ways. Thus, in the field, various mechanical lifting and transfer devices are known, which facilitate the personnel's work. However, the mechanical devices are nearly always large, thus often creating problems in storing them. The they also demand a large space when being used, for which reason they cannot be used in all places. Due to their construction, the said devices are also very expensive.

Cheaper solutions are also in use. Thus in hospital environments various kinds of sheet-like solution are used under a patient in a bed, which are used for two purposes; to prevent dirtying and wetting of the bed and also to slide the patient on top of it. Problems include perspiration and a dangerous ability to slide easily in all directions.

Sheets are also known, which have oriented sliding properties. Thus, for example a sheet has been developed, which slides easily in one direction but not so easily in another. This achieves the advantage that the said type of sheet remains well in place in the longitudinal direction of the patient's bed, but the patient can be slid in the transverse direction of the bed, thus making it easier to lift them into, for instance, a wheelchair from the side of the bed.

The type of sheet referred to above is a good improvement over the existing series of aids, but it too has its deficiencies. Thus, the type of sheet referred to certainly withstands sliding a patient on a bed, but its properties will not withstand the weight of patients when trying to lift them. Therefore other means are required for lifting, with the actual lifting usually still being performed manually, at the same time involving a risk of strains and similar injuries.

An additional drawback of the aforementioned structure is that it brings no help to a problem appearing in a hospital environment, which is due to secretions and faeces dirtying a patient's bed/mattress.

An additional drawback in many of the known solutions in the field is single use. Though a single-use means, for example some kind of sheet, is as such an appropriate solution, single use, being a wasteful system, cannot be approved if there were a more durable solution, which can be washed many times.

BRIEF SUMMARY OF THE INVENTION

The intention of the present invention is to develop an appliance, a transfer cover, which incorporates a construction that eliminates all of the aforementioned drawbacks and deficiencies. The intention is thus particularly to achieve a structure, which will permit a patient to be slid along a bed or other base, their lifting using the same appliance, and be certain to ensure that the patient's secretions will not dirty the base, especially the mattress, under the appliance. An additional intention is to create a transfer sheet that is not single-use, but which can be washed tens, if not hundreds of times, and always be used as if new.

The aforementioned and other advantages and benefits of the present invention are achieved in the manner described as characteristic in the accompanying claims.

BRIEF DESCRIPTION OF THE DRAWINGS

A more detailed description of the invention is given with reference to the accompanying figures, showing one well-regarded embodiment of the invention.

DETAILED DESCRIPTION OF THE PREFERRED EMBODIMENTS

Figure 1:
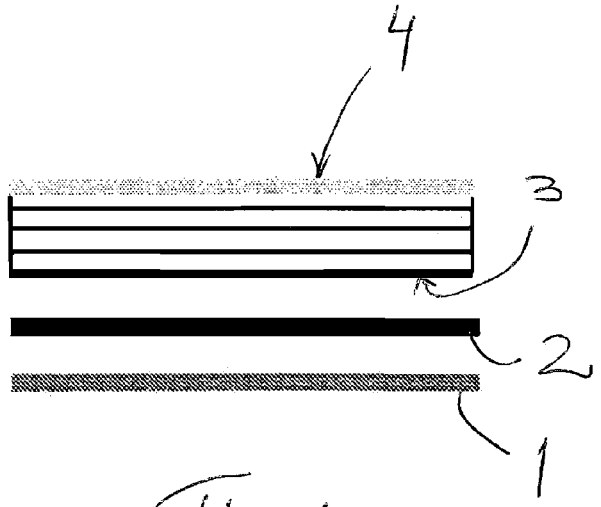
FIG. 1 shows a cross-section of an exemplary construction according to the invention.

Thus, FIG. 1 shows roughly one alternative cross-sectional construction for the appliance according to the invention. Thus, when being used, the lower layer 1 is of a material that slides easily in one direction, but sliding in the other direction is difficult. The transfer cover is placed on a base, such as a mattress, in such a way that the direction of easy sliding is lateral, whereas sliding in the longitudinal direction of the bed, on the other hand, does not take place. Thus the patient will remain in place on the bed, even if the end of the bed is raised above the rest of it, for example for meals.

The following layer 2 is of a sturdy fabric, which is strong enough to permit the patient to be lifted safely. Layer 2 thus takes most of the forces caused by lifting. This aspect will be described later in greater detail.

A moisture-barrier layer 3 and a moisture-absorbing structure 4, which can consists of one or more layers, are situated on top of the aforementioned layers 1 and 2. The layers 3 and 4 actually form a single moisture-protected layer structure. Though the moisture-barrier layer 3 can be a separate membrane, it is mainly a plastic-based membrane suitably laminated onto the surface of the layer structure 4. Polyurethane is a material particularly suitable for this purpose.

One problem in nearly all the known structures, which are used under patients, has been that fluids leak through the base into the mattress or similar. This causes considerable costs annually, because it is certainly not cheap to wash mattresses. These problems are avoided in the structure according to the invention.

Figure 2:
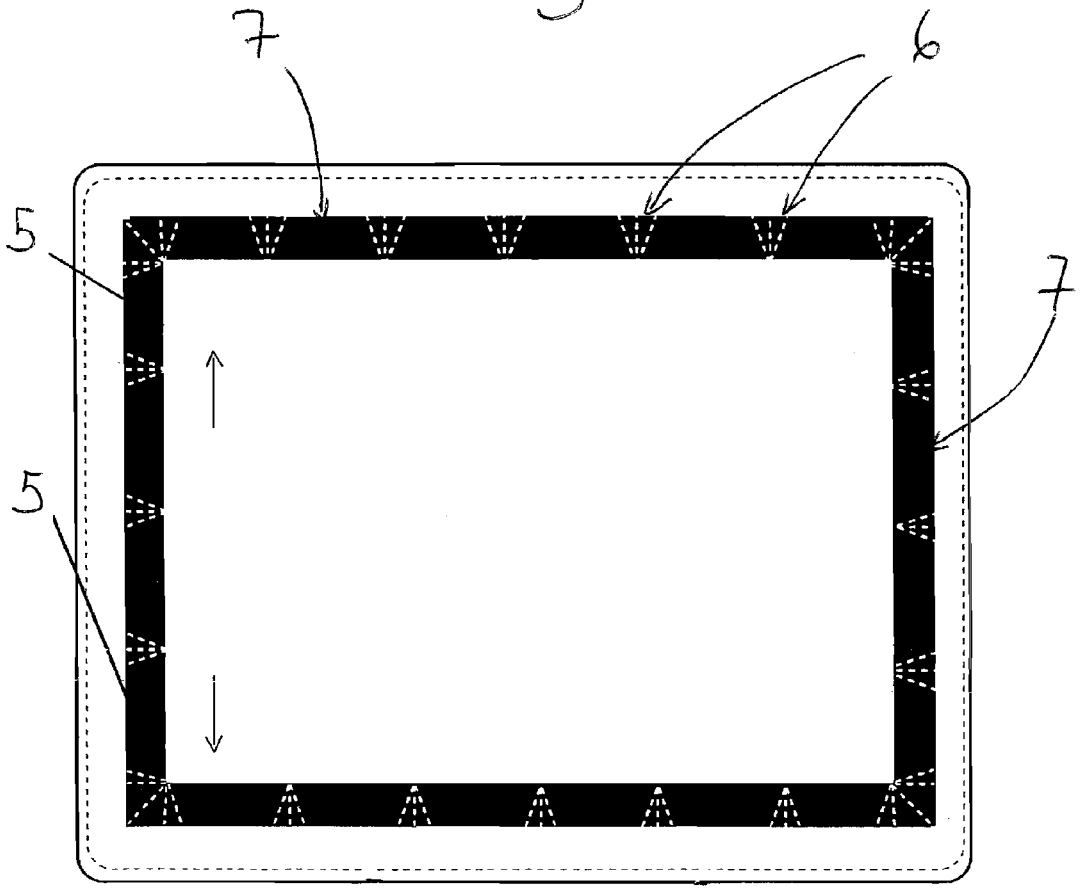
FIG. 2 shows the lower layers of the construction shown in FIG. 1.

FIG. 2 shows a view of the transfer cover according to the invention, seen from underneath. The lowest layer is of a sliding fabric 1, which thus permits easy sliding in one direction (for example, the direction of the arrows), but quite difficult sliding in the other direction. When in use, there is a support-fabric layer 2 on top of the sliding fabric, which is not visible in FIG. 2, but which extends essentially over the entire area of the transfer cover. On the other hand, FIG. 2 shows a somewhat narrow strip 5, which can be of the same material as the support fabric and which is located under the sliding fabric and forms handles 7, 7 as follows. By means of lines of stitches 6, which bind to each other the strip 5, the sliding fabric 1, and the support fabric 2, the said fabrics are sewn together at certain intervals. Thus, the areas between the stitches 6 of the strip 5 form suitable handles to take hold of.

The shape of the lines of stitches, as seen in FIG. 2, widens towards the edge, by means of which shape it has been shown that a very durable construction can be achieved. A sufficient number of lines of stitching are made to form the desired number of handles. By way of example, it is shown that there are six handles on the long sides of the transfer cover and four on the short sides. The numbers are of course adapted to suit the dimensions of the transfer cover.

The moisture-absorbing and moisture-isolating surface layer or layers are attached at their very edges to the combination of a support fabric 2 and sliding fabric 1 described above. The attachment can be made in any suitable manner whatever, for example, by sewing. In FIG. 2, the broken-line visible at the extreme edges symbolizes this sewn joint, by way of example. Stitching in the extreme edge areas is not important in terms of fluid leakage, as the patient's weight causes the area of the structure on which they lie to be depressed slightly below the edges, so that there is no danger of leakage. It is obvious that, if desired, the joint between the support fabric 2 and the absorbent layer can be made in some other way. The desired joint can be implemented, for instance, using the Velcro principle, in which case it will be possible to separate the layers from each other if desired.

The construction of the transfer cover according to the invention can be varied from that described above. Thus, one alternative is that properties, which are the same as, or nearly the same as those in the sliding fabric 1 can be created in the support fabric 2. In this situation, the layers 1 and 2 can be combined in such a way that the sliding fabric is eliminated and the properties of the support fabric 2 are used for the oriented sliding properties. In this way, the construction is made very simple, but nevertheless very suitable for its intended purpose.

As can be seen from the above, the transfer cover according to the invention is multi-purpose and reliable for various reasons. For example, fluids cannot penetrate the structure, because there is no path in its area over which fluid can escape from the base. For the first time, the structure is also such that it is entirely safe not only for transfer but also for lifting. Whereas the structures known up until now have only been able to be used to transfer a patient on the base, it is now possible to use the same transfer cover for clearly lifting, from which it follows that the work is clarified and rationalized, because intermediate moves are not needed during transfer, instead a patient can be transferred from start to finish using the same means.

The transfer cover according to the invention is also easy to use, as it has handles on all sides and these are sufficiently many that the assisting personnel can get a good and balanced grip by selecting only a suitable handle for the task, which will lead to improved patient safety.

If the appliance according to the invention dirties for any reason, it is simply washed. Due to the size and materials, special arrangements are not needed for washing, an ordinary industrial washing machine, or even a domestic washing machine being quite sufficient for this purpose.

The materials are selected in such a way that their shrinkage properties correspond to each other, so that the transfer cover will remain in shape from one washing to the next.

Adapting the details of the transfer cover according to the invention is each and belongs to the basic idea of the invention and the scope of protection of the accompanying Claims.

The invention claimed is:

1. A transfer cover for transferring and lifting persons with restricted movement or immobile persons, the transfer cover comprising:

a layered sheet having an upper layer formed of a moisture-absorbent material equipped with an impermeable protective layer, the upper layer and the protective layer being joined at edges thereof to a support layer configured to permit lifting, the support layer extending essentially over the entire area of the transfer cover; and handle parts provided at the edge areas, the handle parts permitting gripping, on at least two sides of the layered sheet, wherein one of the support layer and a separate layer underneath the support layer is configured with oriented sliding properties in which the support layer or the separate layer is configured to slide well in one direction and poorly in another direction with respect to a base on which the transfer cover is disposed, the transfer cover is configured to entirely support a person in a lifted state, the transfer cover is configured to be machine-washable, and the handle parts are formed by strips of support fabric separated by discontinuous lines of stitching in the strips of support fabric, the lines of stitching being transverse to edges of the strips of support fabric which are located adjacent to outer edges of the transfer cover.

2. The transfer cover according to claim 1, wherein the protective layer, on the surface of the moisture-absorbent layer, is against the support layer.

3. The transfer cover according to claim 2, wherein the protective layer extends to sides of moisture-absorbent layer.

4. The transfer cover according to claim 1, wherein the handle parts are on four sides of the layered sheet.

5. The transfer cover according to claim 1, wherein the moisture-absorbent layer is without structures penetrating the moisture-absorbent layer, except for at extreme edges thereof.

6. The transfer cover according to claim 1, wherein all the layers are attached to each other in a permanent manner.

7. The transfer cover according to claim 1, wherein the moisture-absorbent layer is formed of several layers on top of each other.

8. The transfer cover according to claim 1, wherein the direction in which the support layer and the separate layer slide well is a transverse direction of the base of the transfer cover.

* * * * *